US005177992A

United States Patent [19]

Aoki et al.

[11] Patent Number: 5,177,992

[45] Date of Patent: Jan. 12, 1993

[54] DEVICE FOR FEEDING THIN-WEB FRAME

[75] Inventors: Hideji Aoki; Toshinobu Banjo, both of Fukuoka, Japan

[73] Assignee: Mitsubishi Denki Kabushiki Kaisha, Tokyo, Japan

[21] Appl. No.: 747,959

[22] Filed: Aug. 21, 1991

[30] Foreign Application Priority Data

Aug. 23, 1990 [JP] Japan ..... 2-220033

[51] Int. Cl.[5] ..... B21J 13/10

[52] U.S. Cl. ..... 72/420; 72/422; 226/162; 226/158

[58] Field of Search ..... 72/420, 421, 422; 226/158, 160, 162, 163, 164

[56] References Cited

U.S. PATENT DOCUMENTS 3,613,980 10/1971 Kulig et al. ..... 226/162
4,883,210 11/1989 Kato ..... 226/158

FOREIGN PATENT DOCUMENTS 61290727 6/1985 Japan .
0027130 2/1986 Japan ..... 72/420
0074740 4/1986 Japan ..... 72/422
2455931 1/1981 United Kingdom ..... 72/422
2130953 6/1984 United Kingdom ..... 72/420

*Primary Examiner*—Lowell A. Larson
*Assistant Examiner*—Michael J. McKeon
*Attorney, Agent, or Firm*—Leydig, Voit & Mayer

[57] ABSTRACT

A thin-web frame feeding device for intermittently feeding a thin-web frame at a predetermined pitch along a guide rail has first and second shafts supported by bearing stands for synchronized axial sliding motion in the same direction and for rotation in opposite directions. The first and second shafts are provided with feeding claws rotatable in accordance with the rotation of the shafts into and out of positions where spontaneous portions of the thin-web frame are clamped. The feeding claws are axially moved in accordance with the axial sliding movement of the shafts to feed the thin-web frame.

8 Claims, 3 Drawing Sheets

DEVICE FOR FEEDING THIN-WEB FRAME

BACKGROUND OF THE INVENTION

1. Field of the Invention

The present invention relates to a device for intermittently feeding a thin-web frame at a predetermined pitch.

2. Description of the Related Art

FIGS. 4 and 5 show a known device for feeding a thin-web frame used in a die apparatus. More specifically, FIG. 4 is a top plan view of the die apparatus with an upper die member thereof removed, while FIG. 5 is a side elevational view of the die apparatus. Referring to these Figures, a thin-web frame 1 is fed by a feeding device 2 along a guide rail 4 intermittently at a predetermined pitch. The feeding device 2 has a feeding shaft 22 to which a pair of feed arms 21 are fixed at a predetermined spacing from each other. Each arm 21 has a pair of pins 21*a* for engaging locating holes 1*a* formed in the thin-web frame 1. The feeding shaft 22 is connected to a driving unit 23 which has, for example, a hydraulic cylinder, slidingly driven in the directions of arrows Q-P. A grooved plate 24 has a groove which receives a roller 25 provided on one end of one of the arms 21 such that the roller 25 can roll back and forth in the directions of arrows Q-P. The grooved plate 24 is held stationary. The die apparatus has lower and upper die members 31 and 32 which cooperate with each other in deforming the thin-web frame 1 into a desired configuration and four guide posts 33 secured to the lower die member 31 and for guiding the upper die member 32 in alignment with the lower die member 31 when the upper die member 32 is moved up and down by operation of a press machine 5. The upper die member 32 is provided with a projection 32*a* which engages the guide rail 4 to move it downward when the upper die member 32 is lowered by the press machine 5. A compression spring (not shown) is loaded to act on the underside of a portion of the guide rail 4 projecting outward from the die apparatus 3 so that the guide rail 4 is floated above the lower die member 31 as illustrated.

In operation, the upper die member 32 is lifted by the press machine 5 up to top dead center. As a consequence, the guide rail 4 is floated by the resetting force produced by the compression spring (not shown), so that the pins 21*a* on the feed arms 21, which have been stationed in alignment with the locating holes 1*a* in the thin-web frame 1, are inserted into these locating holes 1*a*. Subsequently, the driving unit 23 drives the feeding shaft 22 in the direction of the arrow P. As a result, the feed arm 21 fixed to the feeding shaft 22 are moved in the same direction and by the same distance as the feeding shaft 22 while being held in a horizontal position by cooperation between the roller 25 and the grooved plate 24, whereby the thin-web frame 1 is fed by a predetermined distance in the direction of the arrow A. Then, the press machine 5 commences its downward stroking so as to push the upper die member 32 downward so that the upper die member 32 moved downward along the guide posts 33. At the same time, the guide rail 4 is pushed downward by the projection 32*a* of the upper die member 32 so as to move downward by a predetermined distance. Consequently, the thin-web frame 1 is pressed against the lower die member 31 and, when the press machine 5 completes its downward stroke to the bottom dead center, the portion of the thin-web frame 1 pressed between the lower and upper die members 31, 32 is plastically deformed into a predetermined configuration. The press machine then commences upward stroking operation to lift the upper die member 32. While the guide rail 4 is in the lowered state, the feeding shaft 22 has been returned by the driving unit 23 in the direction of the arrow Q so that the feed arms 21 have been reset to the initial positions. The above-described operation is then repeated to feed the thin-web frame 1 intermittently, thereby conducting the press work over the whole length of the thin-web frame 1.

Thus, the known feeding device for feeding thin-web frame feeds the thin-web frame by means of pins on the feed arms engaging locating holes formed in the thin-web frame. It is therefore necessary to change feed arms or the whole feeding device in accordance with the types of the thin-web frame conveyed. Another problem is that, since the die apparatus, feeding device and the external driving unit for driving the feeding device are constructed separately and the feeding device is drivingly connected to the driving unit through the feeding shaft, change of die members in accordance with a change in the type of the press work requires changing or re-combining the feeding device, requiring an impractically long time.

SUMMARY OF THE INVENTION

Accordingly, an object of the present invention is to provide a thin-web frame feeding device which can clamp and feed a thin web frame, thereby overcoming the above-described problems of the prior art.

Another object of the present invention is to provide a die apparatus incorporating a feeding device for clamping and feeding a thin-web frame and means for disconnectably connecting the feeding device to an external driving unit.

To these ends, according to one aspect of the present invention, there is provided a device for feeding a thin-web frame intermittently at a predetermined pitch, comprising a first shaft and a second shaft which are horizontally supported by bearings for horizontal sliding motion and rotation in opposite directions in synchronization with each other, and a first claw and a second claw which are fixed to the first and second shafts for clamping spontaneous portions of a thin-web frame thereby feeding it in accordance with the horizontal sliding movement of the first and second shafts.

According to a second aspect of the present invention, there is provided a die apparatus having a lower die member including a die, an upper die member having a punch, guide posts provided on the lower die member for guiding the upper die member in alignment with the lower die member during downward stroking of the upper die member towards the lower die member, and a feeding device of the same type as that stated above, the feeding device being united with the lower die member. The first and second claws of the feeding device clamp spontaneous portions of the thin-web frame and feed it intermittently at a predetermined stroke, along a guide rail laid between the die and the punch of the die apparatus. The feeding device is secured to the lower die member and disconnectably coupled to an external drive means so as to be driven by the drive means.

Thus, the feeding device in accordance with the first aspect of the invention clamps the thin-web frame at spontaneous portions of the frame.

The die apparatus in accordance with the second aspect of the invention incorporates the feeding device such that the feeding device is disconnectable from the external driving unit. When the set of the punch and the die is changed in accordance with requirements, such as a change in the type of the thin-web frame, the whole die apparatus including the feeding device can be changed.

DESCRIPTION OF THE PREFERRED EMBODIMENTS

An embodiment of the present invention will be described with reference to the accompanying drawings.

Figure 1:
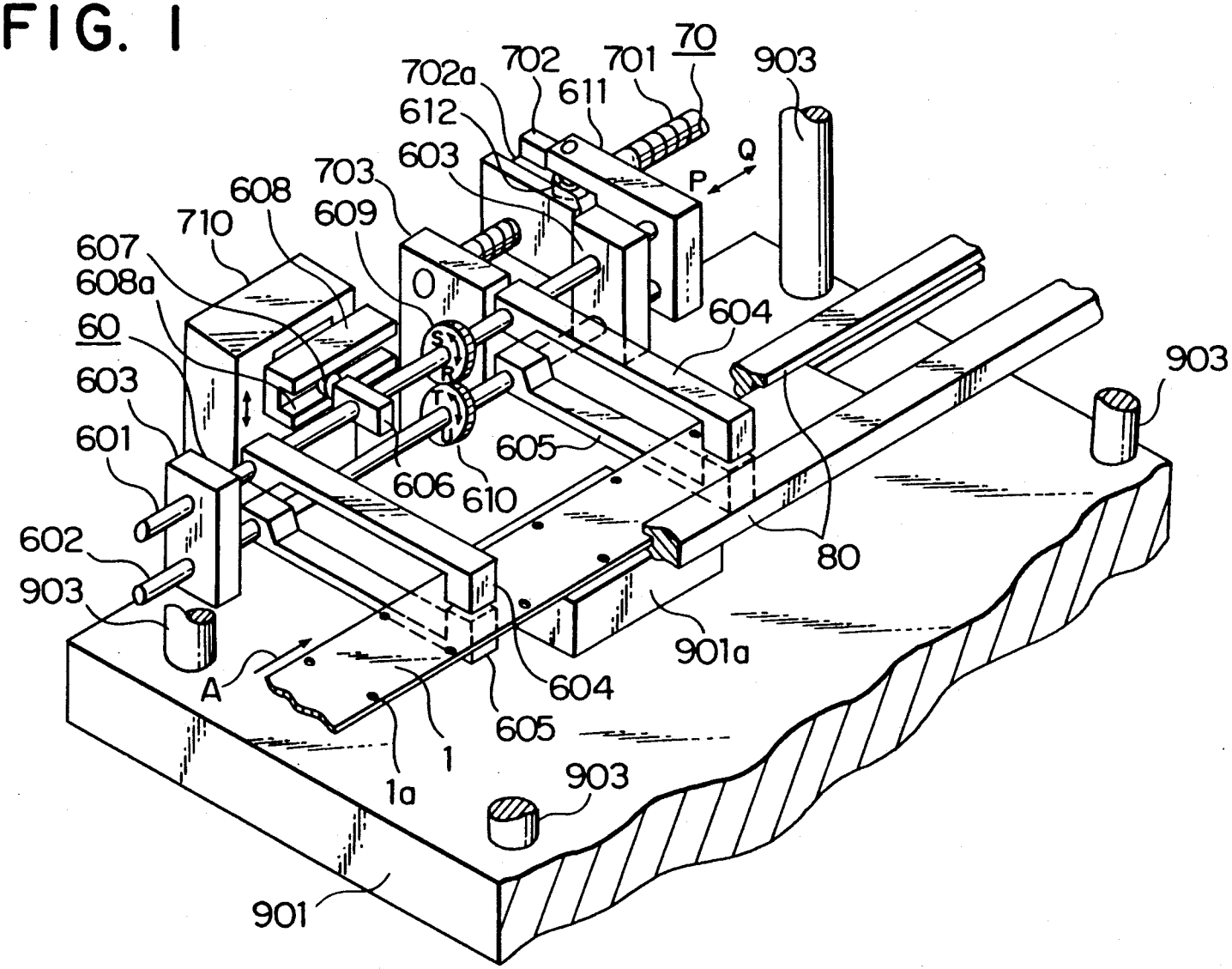
FIG. 1 shows, in a perspective view, a thin-web frame feeding device in accordance with one embodiment of the invention, incorporated in a die apparatus, with the upper die member of the die apparatus removed.
Figure 2:
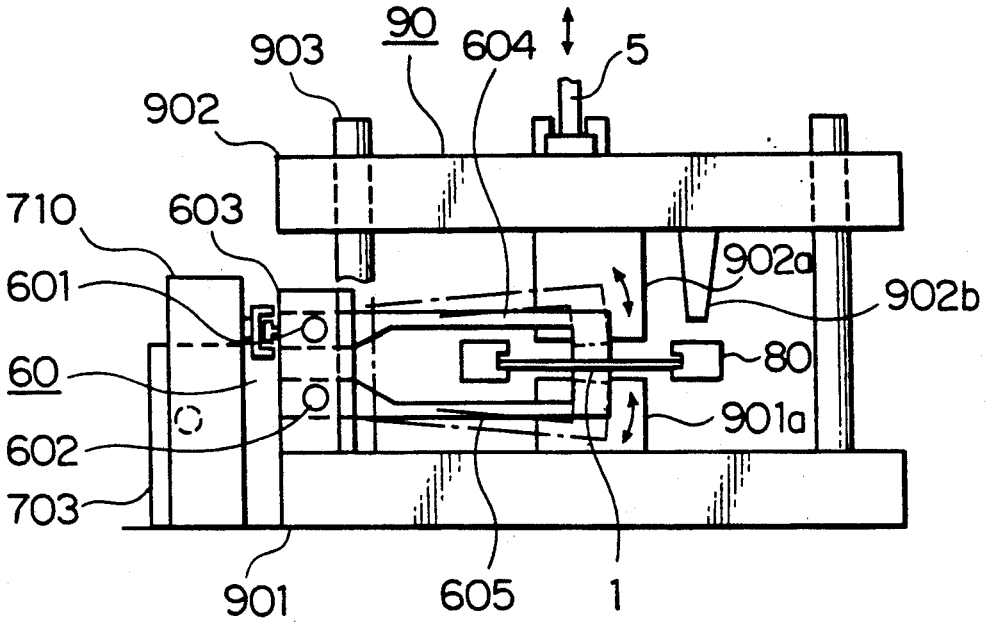
FIG. 2 is a side elevational view of the thin-web frame feeding device mounted in the die apparatus as shown in FIG. 1.

Referring to FIGS. 1 and 2, a thin-web frame feeding device 60 has a first shaft 601 and a second shaft 602 which are horizontally supported for axial and rotational sliding motions by a spaced pair of bearing stands 603 and are parallel to each other. The first shaft 601 has a pair of first claws 604 fixed thereto at a predetermined spacing from each other. The second shaft 602 has a pair of second claws 605 fixed thereto at a predetermined spacing from each other. The spacings and the positions of the first and second claws 604, 605 are determined such that these claws 604, 605 can cooperate with each other in clamping the thin-web frame 1 therebetween. An arm 606 for rotation of the first and second shafts 601, 602 is fixed to one 601 of these two shafts. A roller 607 is provided on one end of the arm 606. The roller 607 disengageably engages a groove 608*a* of a support block 608 for reciprocating movement along the groove 608*a*. The support block 608 is driven by vertical drive unit 710 an external drive unit along the axis of rotation of the shaft, whereby the first shaft 601 is rotated. First and second gears 609, 610 are fixed to the first and second shafts 601, 602 and mesh with each other to transmit the rotation of the first shaft 601 to the second shaft 602. A coupling plate 611 rotatably holds the first and second shafts 601, 602 at one end while the other end of the coupling plate 611 is provided with a transmission roller 612 which disengageably engages with the external drive unit 70, so as to cause the first and second shafts 601, 602 to reciprocatingly move as indicated by arrows P-Q. The external drive unit 70 has a drive transmission block 702 which converts the rotational motion of the drive shaft 701 rotatably carried by an external bearing stand 703 into a linear motion and transmits this linear motion to the connecting plate 611 through the engagement between the groove 702*a* and the transmission roller 612. In this embodiment, the coupling plate 611 is moved reciprocally in the directions of the arrows P-Q. As a consequence, the thin-web frame 1 is fed along guide rails 80.

Referring now to FIG. 2, a die apparatus 90 has a lower die member 901 provided with a die 901*a*, an upper die member 902 provided with a punch 902*a*, and four guide posts 903 which are fixed to the lower die member 901 and which guide the upper die member 902 in alignment with the lower die member 901 during stroking of the upper die member 902. The die 901*a* and the punch 902*a* cooperate with each other in deforming a portion of the thin-web frame 1 into a desired configuration in a known manner. The upper die member 902 is actuated up and down by a press machine 5, and is provided with a projection 902*b* to press the guide rail 80 downward when the upper die member 902 is moved downward by the press machine 5. A compression spring (not shown) is loaded to act on the underside of a portion of the guide rail 80 extending outward of the die apparatus 90 so as to normally urge the guide rail 80 to a position where it floats above the die 901*a* of the lower die member 901. As will be seen from FIGS. 1 and 2, the whole feeding device 60 having the described components 601 to 607 and 609 to 612 is integrally mounted on the lower die member 901. The engagement between the roller 607 of the arm 606 and the groove 608*a* in the support block 608, as well as the engagement between the transmission roller 612 of the coupling plate 611 and the groove 702*a* in the drive transmission block 702, is releasable, so that the whole die apparatus with the feeding device 60 incorporated therein can easily be separated from the external drive unit 70 including the vertical drive unit 710. It is to be understood that the coupling plate 611, transmission block 702 and some of other components are omitted from FIG. 2 for the purpose of clarification.

The operation is as follows. Referring to FIGS. 1 and 2, the press machine 5 operates to lift the upper die member 902 up to top dead center along the guide posts 903. The guide rail 80 also is moved upward in synchronization with the upward movement of the upper die member 902 by the force of the aforementioned compression spring, whereby the thin-web frame 1 held on the guide rail 80 is lifted to and stationed at a predetermined elevated level. Then, while the first and second feeding claws 604, 605 are in "open" positions where they are fully spaced from each other, the drive unit 710, which is a second external drive means for causing rotation of the shafts, operates to lift the support block 608 by a predetermined distance. This movement causes, through an action of the roller 607, the arm 606 to be rotated so that the first shaft 601 is rotated in the direction of an arrow R. This rotation is transmitted to the second shaft 602 through the first and second gears 609, 610 meshing each other, so that the second shaft 602 is rotated in the counter direction T to and by the same angle as the rotation of the first shaft 601. Consequently, the feeding claws 604, 605 are moved to "close" positions where they spontaneously clamp the thin-web frame 1 which has been stationed. In this state, the drive shaft 701 of the drive unit 70 as a first external driving means for causing horizontal motion is rotated to move the transfer block 702 in the direction of the arrow Q, so that the coupling plate 611 is moved through the action of the transfer roller 612. As a consequence, the first and second shafts 601, 602 which are rotatably held by the coupling plate 611 are simultaneously moved so that the first and second feeding claws 604, 605 which are fixed to the first and second shafts 601, 602 are moved a predetermined distance together with the thin-web frame 1 clamped therebetween, thereby feeding the thin-web frame 1. After completion of the feeding of the thin-web frame 1, the drive unit 710 for rotation operates to lower the support block 608 so that the first shaft 601 is rotated through the actions of the roller 607 and the arm 606. This causes the first and second gears 609 and 610 to rotate in directions of arrows S and U, respectively, whereby the first and second feeding claws 604, 605 are moved to the "open" positions thereby releasing the thin-web frame 1. Subsequently, the press machine 5 commences its downward stroke to lower the upper die member 902, which in turn causes the projection 902*b* of the upper die member 902 to push the guide rail 80 downward, whereby the guide rail 80 is moved downward until the thin-web frame 1 is stopped by the working surface of the die 901*a* on the lower die member 901. The press machine 5 conducts its further downward stroke to bottom dead center through a working region in which the punch 902*a* of the upper die member 902 cooperates with the die 901*a* on the lower die member 901 to plastically deform or punch a portion of the thin-web frame 1 into a desired configuration. Meanwhile, the first and second feeding claws 604, 605 of the feeding mechanism 60, still held in the "open" positions, are moved by the drive unit 70 in the direction of the arrow P to the initial position where they are stationed for the next feeding cycle. It is thus possible to intermittently feed and process the thin-web frame 1.

As described before, the transmission roller 612 of the coupling plate 611 and the roller 607 of the arm 606 can be freely brought into and out of engagement with the associated grooves, i.e., the groove 702*a* in the drive transfer block 702 and the groove 608*a* in the support block 608. The whole die apparatus 90, with the feeding mechanism 60 mounted therein, can be freely coupled to and separated from the external drive means including the vertical drive unit 710 for rotation and the drive unit 70 for horizontal motion. The amount of feed of the thin-web frame 1 per cycle can be adjusted by varying the number of rotations of the drive shaft 701 of the drive unit 70 per unit time.

In the described embodiment, the arm 606 is fixed to and held by the first shaft 601. This, however, is only illustrative and the arrangement may be such that the arm 606 is fixed to the second shaft 602, with the position of the support block 608 changed accordingly.

Figure 3:
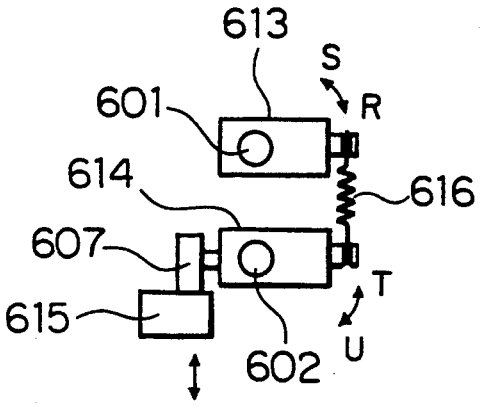
FIG. 3 is a schematic illustration of a portion of another embodiment of the thin-web frame feeding device.
Figure 4:
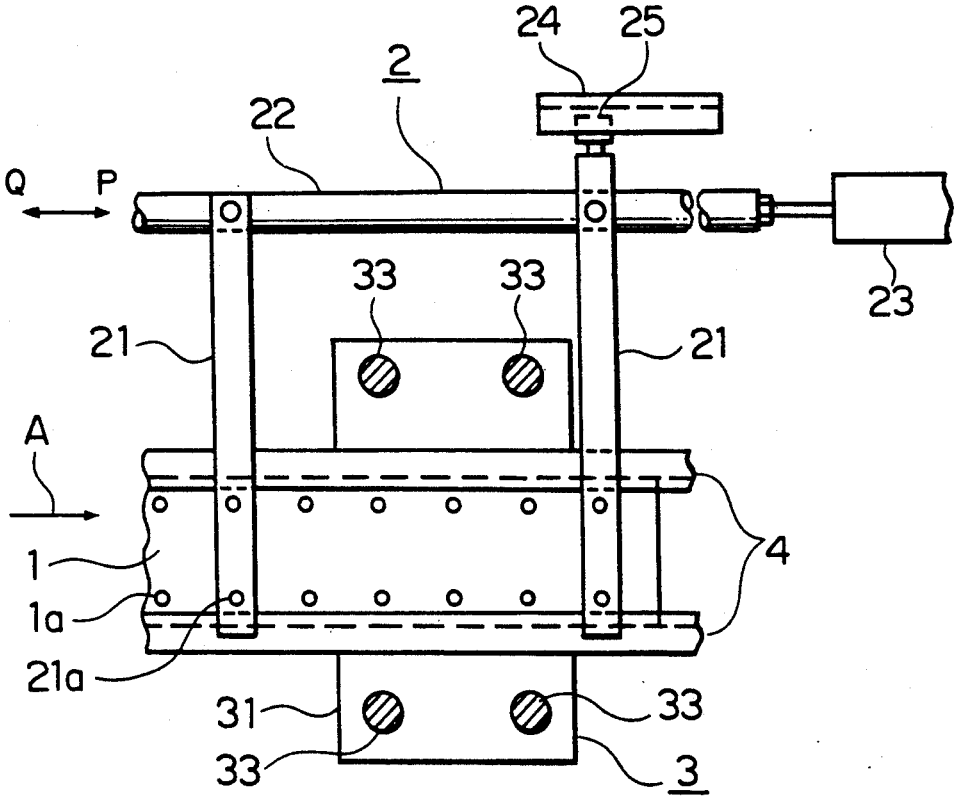
FIG. 4 PRIOR ART
FIG. 4 is a plan view of a known thin-web frame feeding device and a known die apparatus, with an upper die member of the die apparatus removed.
Figure 5:
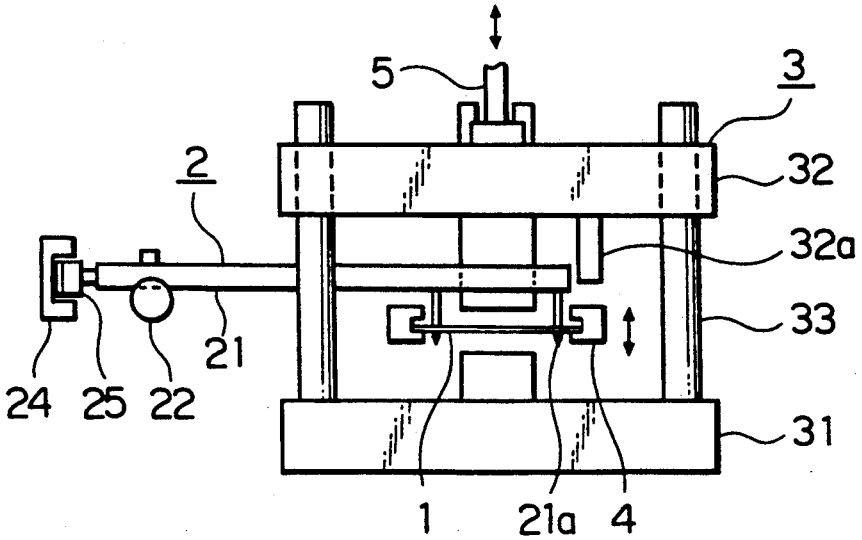
FIG. 5 PRIOR ART
FIG. 5 is a side elevational view of the thin-web frame feeding device and the die apparatus shown in FIG. 4.

Rotation of the first and second shafts in the described embodiment is effected by a vertical movement of the support block 608. This arrangement, however, is only illustrative and may be replaced by, for example, an arrangement of another equipment, a portion of which is shown in FIG. 3. More specifically, in the embodiment shown in FIG. 3, first and second arms 613, 614 are fixed to the first and second shafts 601, 602 and the ends of these arms 613, 614 adjacent the feeding claws 604, 605 are biased towards each other by an elastic member 616 such as a tensioning spring stretched therebetween, whereby the feeding claws 604, 605 are normally urged to the "close" positions where these claws 604, 605 clamp the thin-web frame 1. The operation for driving these claws 604, 605 for releasing the thin-web frame 1 is conducted as follows. A lifting plate 615 is elevated by the vertical drive unit 710 shown in FIGS. 1 and 2, so that the second shaft 602 is rotated in the direction of the arrow U through the actions of the roller 607 and the second arm 614. At the same time, the first shaft 601 is rotated in the direction of the arrow S, through the actions of the first and second gears 609, 610. It is thus possible to move the feeding claws 604, 605 to the "open" position thereby releasing the thin-web frame 1.

Although in the described embodiment, the drive unit 70 for horizontal feed is of the type which employs a drive shaft 701, it will be obvious to those skilled in the art that other types of drive units can equally be used in place of this drive unit 70.

As will be understood from the foregoing description, in the thin-web frame feeding apparatus of the invention, the feeding claws clamp the thin-web frame at spontaneous portions of the frame, so that the intermittent feed can be performed without fail regardless of the type of the thin-web frame.

At the same time, the die apparatus of the present invention incorporates a feeding device which can clamp, by means of feeding claws, a thin-web frame at spontaneous positions thereof, the feeding device being mounted in the die apparatus in such a manner that it can easily be coupled to and separated from the external drive means for driving the feeding device. It is therefore possible to change the die apparatus as a unit with the feeding device, thus attaining a remarkable reduction in the preparation time each time the specifications of the work are changed.

What is claimed is:

1. A device for feeding a thin-web frame at a predetermined pitch along a guide rail comprising:

at least two bearing stands;

first and second generally parallel shafts axially slidably and rotatably carried by said bearing stands;

at least one first feeding claw and at least one second feeding claw fixed to said first and second shafts, respectively, extending substantially orthogonally from said respective shafts and substantially aligned with each other, said first and second feeding claws cooperating with each other to clamp said thin-web frame therebetween for feeding said thin-web frame;

a coupling plate rotatably holding said first and second shafts for synchronized axial sliding of said first and second shafts; and rotational drive means for rotating said first and second shafts simultaneously in opposite directions whereby said first and second feeding claws are axially moved by said coupling plate and are rotatingly moved between open and closed positions by said rotational drive means.

2. The device for feeding a thin-web frame according to claim 1 wherein said first and second feeding claws extend in a first direction and said rotational drive means includes an arm orthogonally connected to one of said first and second shafts, said arm having a first end extending substantially in the first direction and a second end extending in a direction opposite to the first direction, and first and second gears mounted on said first and second shafts, respectively, and meshing with each other for transmitting rotation of one of said first and second shafts to the other of said first and second shafts, whereby said feeding claws are moved between the open and closed positions by rotational movement of the second end of said arm.

3. The device for feeding a thin-web frame according to claim 1, wherein said first and second feeding claws extend in a first direction and said rotational drive means includes first and second arms fixed to said first and second shafts, respectively, each of said first and second arms having a first end extending substantially in the first direction and a second end extending in a direction opposite to the first direction, an elastic member disposed between said first ends of said first and second arms urging said first ends of said first and second arms towards each other, and first and second gears mounted on said first and second shafts, respectively, and meshing with each other for transmitting rotation of one of said first and second shafts to the other of said first and second shafts, said feeding claws being normally urged toward the closed position and moved to the open position when said second ends of said first and second arms approach each other.

4. An apparatus comprising:

a die apparatus including a lower die member having a die, an upper die member having a punch, and guide posts fixed to and supported by said lower die member for slidingly guiding said upper die member in alignment with said lower die member during movement of said upper die member towards and away from said lower die member;

a guide rail extending between said die and said punch;

a feeding device mounted on said lower die member including feeding claws for clamping a thin-web frame intermittently at a predetermined pitch along said guide rail, said feeding device including:

(a) at least two bearings, (b) first and second generally parallel shafts axially slidably and rotatably supported by said bearings, (c) at least one first feeding claw and at least one second feeding claw extending in a first direction and respectively connected to and projecting orthogonally from said first and second shafts towards said die and said punch and substantially in alignment with each other for cooperatingly clamping and feeding said thin-web frame, (d) a coupling plate rotatably supporting said first and second shafts for synchronized axial sliding of said first and second shafts, (e) at least one arm fixed to at least one of said first and second shafts and having a first end extending substantially in the first direction and a second end extending in a direction opposite to the first direction, and (f) first and second gears mounted on said first and second shafts, respectively, and meshing with each other for transmitting rotation of one of said first and second shafts to the other of said first and second shafts; and external drive means spaced from said die apparatus and disconnectably drivingly connected to said feeding device for driving said feeding device.

5. The apparatus according to claim 4 wherein said die apparatus is located adjacent to said external drive means and said external drive means includes a first external drive unit disconnectably coupled to said coupling plate for axially sliding said coupling plate generally parallel to said first and second shafts, thereby axially sliding said first and second feeding claws generally parallel to said first and second shafts, and a second external drive unit disconnectably coupled to said second end of said arm for moving said first and second feeding claws between a closed position clamping said thin-web frame and an open position releasing said thin-web frame.

6. The apparatus according to claim 5 wherein said coupling plate includes a transmission roller, said first external drive unit includes an external bearing stand, a drive shaft rotatably supported by said external bearing stand, and a grooved transmission block for converting rotating motion of said drive shaft into linear motion disconnectably engaging said transmission roller for transmitting the linear motion to said transmission roller, thereby driving said transmission roller axially along said first and second shafts, and including a roller disposed on said second end of said arm, said second external drive unit including a grooved support block disconnectably engaging said roller on said arm and including a drive unit for driving said support block in the direction of rotation of one of said first and second shafts.

7. The apparatus according to claim 6 including first and second arms respectively attached to said first and second shafts at respective fixed ends of said first and second arms, a roller attached to the second end of one of said first and second arms engaging the groove in said grooved support block, an elastic member connecting said first ends of said first and second arms and urging said first ends of said first and second arms towards each other holding said first and second feeding claws in the closed position, said first and second feeding claws being moved to the open position when said roller on said second end of one of said first an d second arms is moved towards the other arm.

8. The apparatus according to claim 5 wherein said firstshaft has a pair of said first feeding claws disposed at opposite sides of said die and punch, said second shaft includes said second feeding claws substantially aligned with said pair of first feeding claws.

* * * * *